US005669862A

United States Patent [19]

Sayman

[11] Patent Number: 5,669,862

[45] Date of Patent: Sep. 23, 1997

[54] PORTABLE EXERCISE DEVICE

[76] Inventor: Gunduz Sayman, 2316 Delaware Ave., Ste 604, Buffalo, N.Y. 14216

[21] Appl. No.: 328,279

[22] Filed: Oct. 5, 1994

[51] Int. Cl.[6] ..... A63B 21/045

[52] U.S. Cl. ..... 482/127; 482/140

[58] Field of Search ..... 482/121, 122, 482/123, 127, 140, 124, 148, 139

[56] References Cited

U.S. PATENT DOCUMENTS

| | | | |
|---|---|---|---|
| D. 208,787 | 10/1967 | Bennstrom-Prescott | 482/122 |
| 3,953,026 | 4/1976 | Stokely | 482/127 |
| 3,976,057 | 8/1976 | Barklay | 128/25 |
| 4,483,533 | 11/1984 | Nangiapane | 482/122 |
| 4,606,542 | 8/1986 | Segal | 272/137 |
| 4,681,315 | 7/1987 | Yang | 482/127 |
| 5,176,622 | 1/1993 | Anderson et al. | 482/127 |
| 5,224,914 | 7/1993 | Friedman | 482/140 |

FOREIGN PATENT DOCUMENTS

| | | | |
|---|---|---|---|
| 2591496 | 6/1987 | France | 482/127 |

*Primary Examiner*—S. R. Crow

[57] ABSTRACT

A portable exercise device is described having a first longitudinal member, a second longitudinal member adapted to be grasped by a user and a third longitudinal member. The second member is attached to one end of a first arm at a substantially perpendicular angle, the first arm being attached the first member at a substantially perpendicular angle. The first and third longitudinal members are adapted to bear comfortably against a user's body. The third member is attached to one end of a second arm at a substantially perpendicular angle, the second arm being attached to the first member at a substantially perpendicular angle. At least one of the arms is pivotally mounted to the first member and a spring is provided for resisting any change in the relative position between the first and second arms.

2 Claims, 2 Drawing Sheets

PORTABLE EXERCISE DEVICE

A portable exercise device is described comprising first, second and third members, the second member adapted to be grasped by a user, the second member being mounted to the first member by a first arm. The third member is mounted to the first member by a second arm. At least one of said arms being pivotally mounted to the first member. The first member is substantially longitudinal and the arms are attached thereto at a substantially perpendicular angle. The device also comprises a biasing means for biasing the first and second arms towards a preselected angle and resisting any change in the preselected angle between the arms.

A portable exercise device is also disclosed having first, second and third longitudinal members. The second member is attached to the first member via a first arm, and the third member is attached to the first member via a second arm. The first and second arms are attached to the second and third members, respectively, at substantially perpendicular angles. The first and second arms are attached to the first member at a substantially perpendicular angle. The second member is adapted to be grasped by a user while the first and third members are adapted to bear against the user's body. At least one of the arms is pivotally attached to the first member. A biasing means is also provided for retaining the arms at a preselected angle and resisting any change in the relative position of the arms.

Accordingly, a primary object of this invention is to provide a new and novel exercise device which is readily portable, compact and which is easy to use and inexpensive to manufacture.

Another object of this invention is to provide a new and novel exercise device which can be used to perform a wide variety of exercises each intended to provide a different form of stimulation to selected muscles of the arms, shoulders, and legs.

A further object is to provide an exercise device with varying resistances to user manipulation.

These and other objects and advantages will become apparent when considering the following detailed specification when taken in conjunction with the drawing figures.

A BRIEF DESCRIPTION OF THE DRAWINGS

DESCRIPTION OF A PREFERRED EMBODIMENT

Figure 1:
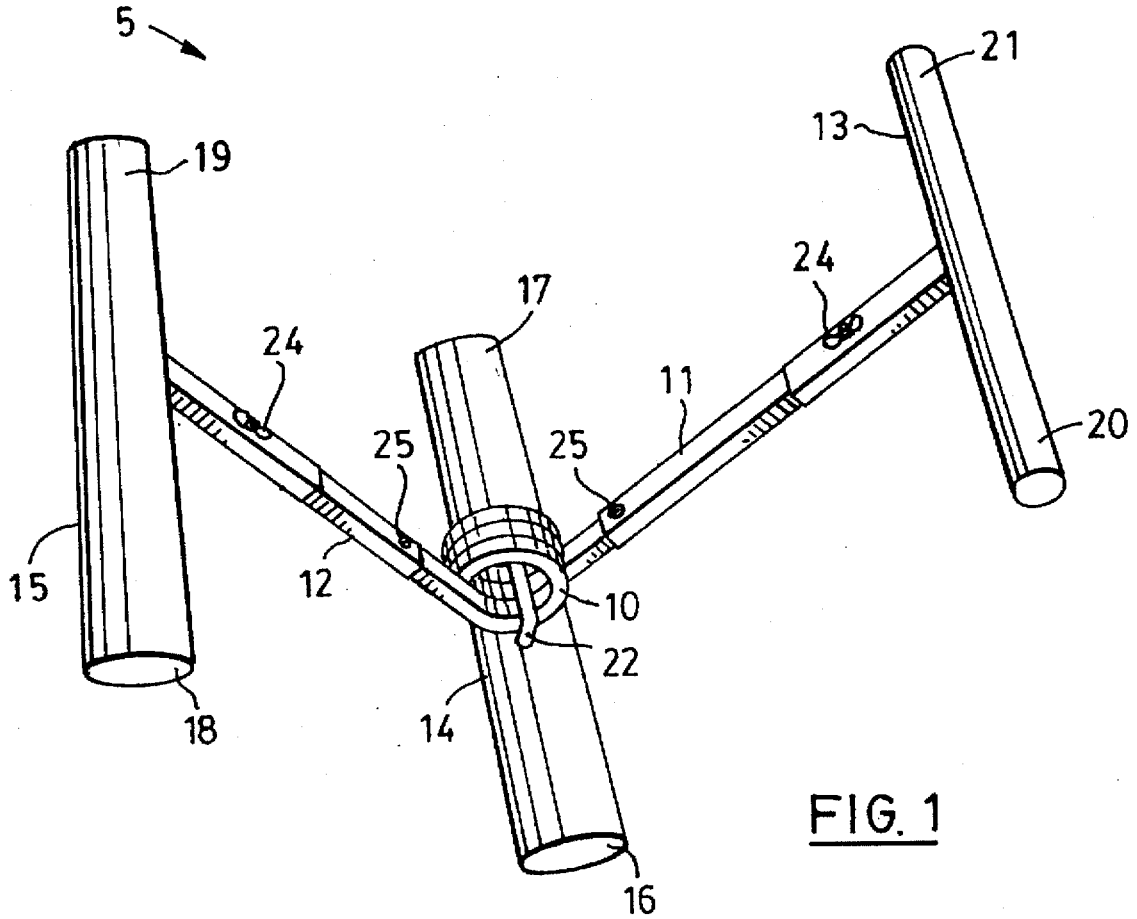
FIG. 1 is a perspective view of the exercise device.

Referring firstly to FIG. 1, the portable exercising device of a preferred form of my invention is illustrated as item 5 and basically comprises biasing means 10 connected to first longitudinal member 14, first arm 11 and second arm 12. The arms are connected to biasing means 10 such that the arms are pivotaly movable relative to first member 14. One end of arm 11 is attached to a second longitudinal member 13 and one end of arm 12 is attached to a third longitudinal member 15.

First longitudinal member 14 has ends 17 and 16. Preferably, ends 16 and 17 are covered with foam pads and configured to bear against a user's body without discomfort. First member 14 is also relatively flat and has an elliptical cross sectional profile. This further allows the first member to comfortably bear against a user's body. First arm member 11 is connected to first longitudinal member 14, via biasing means 10, at a point midway between ends 16 and 17. Second arm member 12 is connected to first longitudinal member 14, also via biasing means 10, at a point midway between ends 16 and 17. Both arms are mounted substantially perpendicular to member 14.

Second longitudinal member 13 is provided with ends 21 and 20. Preferably, ends 21 and 20 are configured to form handles which can be comfortably grasped by a user. Preferably, first arm 11 is perpendicularly attached to second longitudinal member 13 at a point between ends 21 and 20. The attachment of arm 11 at the center of second longitudinal member 13 allows for the smooth transmission of force between second longitudinal member 13 and arm 11.

Third longitudinal member 15 is provided with ends 18 and 19. Second arm 12 is perpendicularly attached to a third longitudinal member at a point midway between ends 18 and 19. As can be seen from FIG. 1, third longitudinal member 15 is relatively flat and has an elliptical cross section. This permits third longitudinal member 15 to bear against a user's body comfortably. Preferably, longitudinal member 15 is covered with a soft foam pad to maximize comfort when in use.

First arm 11 and second arm 12 have adjustable lengths. Wing nut 24 can be removed from the arms and repositioned in holes along the arm members to lengthen or shorten the arms. This allows the device to be adjusted for the user's particular arm and leg length.

Biasing means 10 sets arms 11 and 12 at a preselected angle. The biasing means also resists any change in the relative position between arms 11 and 12. Biasing means 10 is preferably a coiled torsion spring. Other biasing means such as a coiled compression spring or a rubber block may be used. A hydraulic damper may also be used to provide resistance.

Arms 11 and 12 are mounted to biasing means 10 by screws 25. Biasing means 10 is connected to first member 14 by a removable clip 22. The biasing resistance of the device may be modified by replacing biasing means 10 with another spring. This is accomplished by first removing arms 11 and 12 from the biasing means by unscrewing screws 25. Then the biasing means is released from first member 14 by removing clip 22. A new biasing means can be attached to first member 14 and the arms re-attached. Alternatively, arms 11 and 12 can be removed by releasing screws 25. First member 14 with attached biasing means 10 can then be replaced with another longitudinal member having a different biasing spring.

Figure 2:
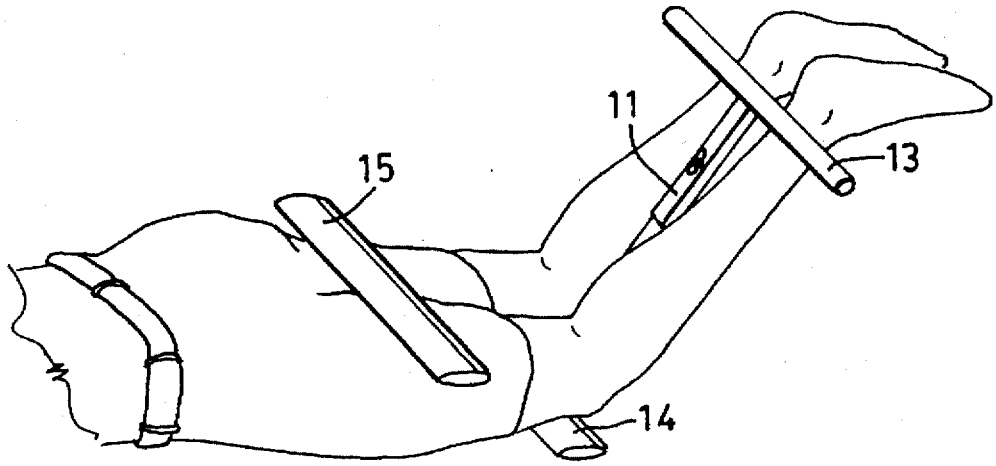
FIG. 2 is a pictorial operational view of the device showing a user exercising his legs with the device.

The portable exercise device can be used for a wide variety of exercises. Operation of the invention may best be seen with reference to FIGS. 2, 3 and 4. The arm of the device can be placed between the user's legs as shown in FIG. 2. The first member 14 is placed adjacent to a user's upper knee, the third member 15 is placed behind the user's thighs, and the second member 13 is positioned behind the user's ankles so that the arms can be pulled by the hamstring muscles towards the back of the user's upper legs against the force of biasing means 10.

Figure 3:
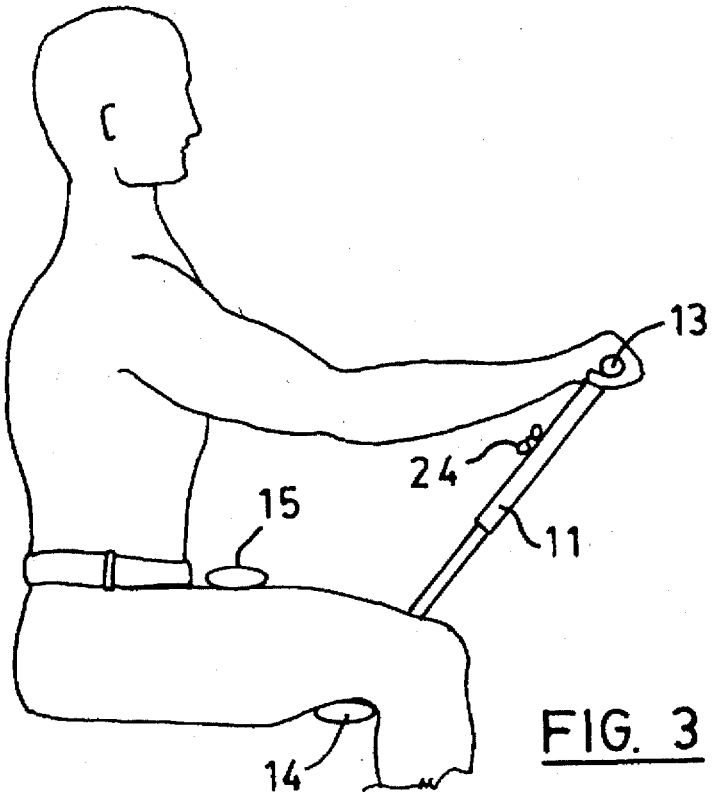
FIG. 3 is an operational side view of the device showing a user exercising his trapezius muscles with the device.
Figure 4:
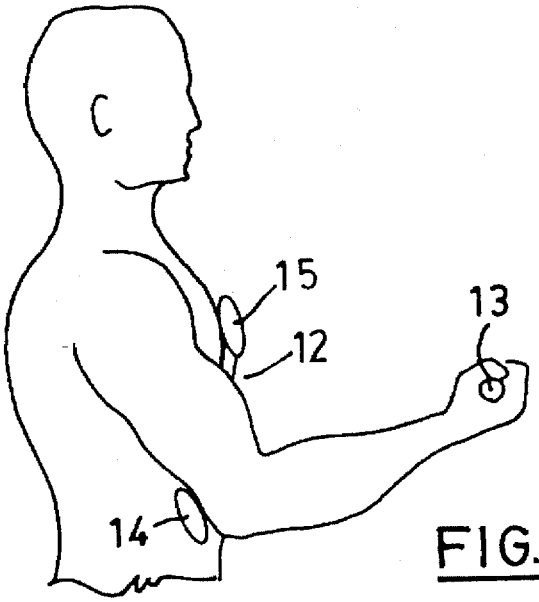
FIG. 4 is an operational side view of the device showing a user exercising his biceps with the device.

The device can also be used to strengthen the muscles of the arms and shoulders by placing the arms between the user's legs as shown in FIG. 3. First member 14 is placed behind the user's lower thighs, and third member 15 is placed on the front side of the user's thighs. Member 13 is grasped and pulled against the force of spring 10 as seen in FIG. 3; hence, exercising the back of the trapezius muscles and the biceps. When the portable exercise device is rotated 180 degrees on its vertical axis from this position, the user can exercise the chest muscles and triceps by pushing member 13 away from the user's body against biasing force.

A user can choose to exercise the biceps only by positioning member 15 on the chest; the user's elbows resting on member 14. Both hands can grasp and pull the handles toward the chest.

The degree of difficulty encountered by a user in pivoting the arms is determined by the type of biasing means used. The level of difficulty can be adjusted by replacing coiled spring 10 with a heavier coil.

While a preferred embodiment of a portable exercise device has been hereinabove fully and completely described, it will be obvious to one of ordinary skill in the art that numerous changes and modification can be made without departing from the spirit and scope of the invention as defined in the appendant claims.

What is claimed is:

1. A portable exercising device comprising:

a pair of length adjustable first and second arms;

a first, generally flattened elliptical-shaped, longitudinal member adapted to bear comfortably against a user's body;

a second longitudinal member adapted to be grasped by the user, said second member attached to one end of said first arm at a substantially perpendicular angle, the first arm attached to the first member at a substantially perpendicular angle;

a third, generally flattened elliptical-shaped, longitudinal member adapted to bear comfortably against a user's body, said third member attached at one end to the second arm at a substantially perpendicular angle, the second arm attached to the first member at a substantially perpendicular angle;

at least one of said arms pivotally attached to the first member; and a torsion spring means mounted to the first member wherein the first and second arms are removably attached to the spring means, said spring means biases the first and second arms when a user attempts to change the relative position between said first and second arms.

2. A portable exercising device as defined in claim 1 wherein the first and third longitudinal members are padded.

* * * * *